US006867358B1

(12) United States Patent
Mester, Jr.

(10) Patent No.: US 6,867,358 B1
(45) Date of Patent: Mar. 15, 2005

(54) METHOD AND APPARATUS FOR PRODUCING IMPROVISED MUSIC

(76) Inventor: Sandor Mester, Jr., Paulay Ede u. 57, Budapest (HU), H-1061

( * ) Notice: Subject to any disclaimer, the term of this patent is extended or adjusted under 35 U.S.C. 154(b) by 42 days.

(21) Appl. No.: 10/048,356

(22) PCT Filed: Jul. 28, 2000

(86) PCT No.: PCT/HU00/00085

§ 371 (c)(1),
(2), (4) Date: May 8, 2002

(87) PCT Pub. No.: WO01/09874

PCT Pub. Date: Feb. 8, 2001

(30) Foreign Application Priority Data

Jul. 30, 1999 (HU) ..... 9902621

(51) Int. Cl.[7] ..... G10H 7/00

(52) U.S. Cl. ..... 84/609; 84/602; 84/649; 84/615

(58) Field of Search ..... 84/645, 600–615, 84/647–653

(56) References Cited

U.S. PATENT DOCUMENTS 5,281,754 A * 1/1994 Farrett et al. ..... 84/609
5,386,081 A * 1/1995 Nakada et al. ..... 84/609
5,679,913 A 10/1997 Bruti et al.
5,773,741 A * 6/1998 Eller et al. ..... 84/609
5,859,379 A 1/1999 Ichikawa
5,877,445 A 3/1999 Hufford et al.
6,175,072 B1 * 1/2001 Aoki ..... 84/636
6,252,152 B1 * 6/2001 Aoki et al. ..... 84/609

* cited by examiner

*Primary Examiner*—Marlon T. Fletcher
*Assistant Examiner*—David S. Warren
(74) *Attorney, Agent, or Firm*—Pillsbury Winthrop LLP

(57) ABSTRACT

A method, an apparatus and a computer program product is described for improvised playing of audio materials (31) in the form of a music piece consisting of sections, wherein the audio materials (31) are associated with the sections and stored in a memory, and the simultaneously playable audio materials (31) are sorted into at least one group (23) for each section, and wherein by means of a computer program one section is selected at random, and then in the selected section one group (23) is selected at random, and the audio materials (31) of the selected group (23) are mixed and supplied to a decoder for being decoded into sounds.

31 Claims, 5 Drawing Sheets

| | | |
|---|---|---|
| A | A | B |
| A | A | C |
| A | B | A |
| A | B | B |
| B | A | A |
| B | A | B |
| B | B | A |
| C | A | A |
| C | A | B |
| C | A | C |

24

Fig. 4

25

26 31 23

32

| | | | | |
|---|---|---|---|---|
| a-11-2x.wav | a-12-2x.wav | a-13-1x.wav | a-11-2x.wav | a-11-2x.wav |
| 8 | 8 | 4 | 8 | 8 |
| 0 | 0 | 0 | 0 | 0 |
| 100 | 100 | 100 | 100 | 100 |
| a-21-1x.wav | a-21-1.wav | a-21-1x.wav | a-22-2x.wav | a-23-1x.wav |
| 4 | 4 | 4 | 16 | 4 |
| 0 | 0 | 0 | 0 | 0 |
| 100 | 100 | 100 | 100 | 100 |
| | | | a-31-2x.wav | a-33-2x.wav |
| | | | 8 | 8 |
| | | | 0 | 0 |
| | | | 100 | 100 |

Fig. 5

27

28

| | | |
|---|---|---|
| b-11-2x.wav | b-11-2x.wav | b-13-2x.wav |
| 8 | 8 | 8 |
| 0 | 0 | 0 |
| 100 | 100 | 100 |
| b-21-1x.wav | b-21-1x.wav | b-23-1x.wav |
| 4 | 4 | 4 |
| 0 | 0 | 0 |
| 100 | 100 | 100 |
| | b-31-1xx.wav | b-32-1xx.wav |
| | 8 | 8 |
| | 0 | 0 |
| | 100 | 100 |

Fig. 6

29

30

| |
|---|
| a-11-2x.wav |
| 4 |
| 0 |
| 100 |
| b-13-2x.wav |
| 4 |
| 0 |
| 100 |
| a-32-2x.wav |
| 4 |
| 0 |
| 100 |
| a-31-2x.wav |
| 4 |
| 0 |
| 100 |

Fig. 7

METHOD AND APPARATUS FOR PRODUCING IMPROVISED MUSIC

This application is the National Phase of International Application PCT/HU00/00085 filed Jul. 28, 2000 which designated the U.S. and that International Application was published under PCT Article 21(2) in English.

TECHNICAL FIELD

The invention relates to a method, an apparatus and a computer program product for improvised playing of audio materials in the form of a music piece consisting of sections. By this method, apparatus and computer program product improvised music can be produced, especially for computer technology, multimedia, telecommunications and entertainment industry applications.

BACKGROUND ART

The development of computer systems resulted in a widespread use of computer technology in the music industry, for example in recording of the sound, in mixing, and in computer aided composing and generating of improvised music.

The implementation of computerised music improvisation offers great opportunities, because the spreading of musical compositions in a digital way—even in the age of efficient compressing methods and high capacity data sources—is restricted by the substantial size of digitised musical compositions. In applications where it is necessary to generate background, incidental or other improvised music, i.e. where the object is not the playing of a particular composition, but an algorithmised improvised music is to be generated in a predetermined style, for example classical, pop, dance music, techno, jazz, applied music etc. on the basis of pre-stored audio data, the storing of the audio data could require a much smaller storage capacity than in the case of storing complete music pieces even in a compressed form.

A method and an apparatus for automatic generation of music of improvised character are described for example in U.S. Pat. No. 5,281,754. This known processor controlled apparatus is designed for improvised playing of pre-stored musical material in the form of a music piece. The apparatus has a memory comprising musical phrases consisting of melody and musical instrument data, from which by means of a random number generator a random sequence of phrases is selected, an accompaniment is generated for the melody of the phrases, random musical instruments are selected for the melody and the accompaniment, and then the musical phrases so generated are supplied to a synthesiser for generating audio signals. The disadvantage of the apparatus is that it generates the music in MIDI format and hence a MIDI compatible synthesiser is required to play the music. The MIDI compatible synthesiser makes the apparatus much mote expensive and furthermore the quality of music generated heavily depends on the quality of the synthesiser. At present, realistic music cannot be generated by means of this known apparatus. A further disadvantage of the apparatus is that it does not allow an arbitrary number and combination of solo instruments to sound at the same time, and so the improvisation is narrowed down to a relatively small range.

An apparatus for an electronic organ serving for generating an improvised accompaniment is described in U.S. Pat. No. 4,616,547. The apparatus stores rhythm and pitch patters and combination rules related thereto in a coded form. The rhythm and pitch patterns are read at random by the apparatus and according to the user's adjustments it improvises an accompaniment to the melody played by the user. This known apparatus is not suitable for generating music per se, because its outputs are linked to the inputs of the electronic organ's sound generating circuits. Therefore, this apparatus can only be used when it is fitted into an electronic organ.

In WO 97/21210 A a method and an apparatus is disclosed for interactively creating new arrangements for musical compositions. A plurality of musical sequences and a template specifying a plurality of fixed sequence positions for arrangements are stored in a database. A user interactively selects from the plurality of fixed musical sequences and interactively allocates the selected sequences among various fixed sequence positions defined by the template, thereby creating a new arrangement. However, this known solution is not suitable for improvising music by a computer program, as the generated music is a result of a particular user arrangement and not of a randomised improvisation according to predetermined improvisation rules.

DISCLOSURE OF INVENTION

The object of the invention is to provide an apparatus which is suitable for producing Improvised music on its own, an apparatus which is relatively simple and thereby can be implemented at a low cost, and by which the disadvantages of known solutions can be eliminated. A further object is to provide an apparatus which is suitable for producing realistic improvised music while allowing a high degree of freedom. Furthermore, the object of the invention is to provide a simple and thereby low cost improvisation method and computer program product.

According to a first aspect, the invention is an apparatus for playing audio materials in the form of a music piece consisting of sections, the apparatus comprising a memory storing the audio materials associated with the sections, a central processing unit connected to the memory, a computer program for controlling the apparatus, and a mixer and a decoder for mixing and decoding into sounds the audio materials. The audio materials are played in an improvised manner by means of the computer program, wherein predetermined sequences of the sections are stored in the memory, the audio materials associated with the sections are sorted into at least one predetermined group for each section, wherein the at least one group is formed according to simultaneously playable audio materials, and wherein by the computer program one sequence of the sections is selected at random, then in succession the sections of the selected sequence are selected, and for each selected section one group of the audio materials is selected at random for playing.

By the apparatus according to the invention, an essentially unlimited improvisation is made possible regarding the number of audio materials sounding simultaneously. In such a way, an extremely rich improvised music can be generated. Sorting the simultaneously playable audio materials into groups allows the setting up of improvisation rules in a simple way.

In a preferred embodiment of the apparatus the memory comprises section databases with records storing references to the audio materials and the at least one group is formed by the records, wherein the memory further comprises a music piece database for storing sequences consisting of references to the section databases.

This embodiment is especially simple to implement by a computer system. Determining the improvisation rules according to the invention gives a broader artistic licence to the composer, because by means of the databases a music piece can be prepared in several versions. In addition, when listening to the same music piece repeatedly, it always has a different sound as a result of the random factor. Therefore, listening to the music becomes more exciting and more varied for the listener.

The records preferably comprise parameters relating to mixing mode and/or playing mode of the audio materials. The audio materials can have a length identical with the length of the corresponding section or they can be of a length corresponding to an integer fraction of the section. The parameters are preferably the number of repetitions within the section, stereo position and relative volume. The audio materials can be sound samples of solo musical instruments obtained by sampling.

The apparatus can be implemented simply, if the section databases are formed as section matrices, wherein lines of the section matrix correspond to the musical instruments and elements of the section matrix in one line are the records containing the references to the sound samples of the corresponding musical instrument, and wherein the groups are formed by records in the same column of the section matrix. The music piece database can preferably be formed as a music piece matrix, wherein the sequences corresponding to music piece variations are stored in the lines of the music piece matrix.

The memory preferably comprises audio materials associated with several groups, which groups can be within one section, in several sections of one music piece or in the sections of several music pieces.

In a particularly preferred embodiment of the apparatus, in the memory still or moving pictures are stored associated with the groups, and the apparatus comprises a unit for displaying the still or moving pictures associated with the selected group when the audio materials of the selected group are played.

The apparatus according to the invention is preferably a computer system, in which the memory is a CD-ROM, and the mixer is arranged in the decoder, wherein the decoder is a sound board comprising a D/A converter.

According to a second aspect, the invention is a method for playing audio materials in the form of a music piece consisting of sections by means of a hardware system, the hardware system comprising a memory storing the audio materials, a central processing unit connected to the memory, and a computer program for controlling the apparatus, wherein the audio materials are associated with the sections and by means of the computer program sections are selected in succession, and the audio materials associated with the selected sections are forwarded to a mixer and a decoder for mixing and converting the audio materials into sound. According to the invention, predetermined sequences of the sections are stored in the memory, the audio materials associated with the sections are sorted into at least one predetermined group for each section, wherein the at least one group is formed according to simultaneously playable audio materials, and an improvised playing of the audio materials is carried out, wherein by the computer program one sequence of the sections is selected at random, then in succession the sections of the selected sequence are selected, and for each selected section one group of the audio materials is selected at random for playing.

The method according to the invention can be implemented very efficiently by means of a computer system, and it offers almost unlimited improvisation possibilities.

According to a third aspect, the invention is a method for playing audio materials in the form of a music piece consisting of sections, wherein the audio materials are stored in a memory and are associated with the sections, and wherein sections are selected in succession and the audio materials associated with the selected sections are played. The audio materials are played in an improvised manner by means of a computer program, wherein the memory comprises predetermined section databases having elements containing references to the audio materials and a predetermined music piece database containing sequences of references to the section databases, and the selection step is carried out by the computer program, wherein the selection step comprises selecting one sequence at random from the music piece database, selecting one group of the elements at random in each section database referenced in succession in the selected sequence, and wherein the audio materials referenced by the elements of the selected group are mixed for simultaneous playing.

According to a further aspect, the invention is a computer program product for playing audio materials in the form of a music piece consisting of sections, wherein the audio materials are associated with the sections and stored in a memory, and wherein the computer program product comprises selecting means for selecting the sections in succession and means for supplying the audio materials associated with the selected sections to a decoder for converting the audio materials into sound. The inventive computer program product plays the audio materials in an improvised manner, wherein predetermined sequences of the sections are stored in the memory, the audio materials associated with the sections are sorted into at least one predetermined group for each section, wherein the at least one group is formed according to simultaneously playable audio materials, and wherein by the computer program product one sequence of the sections is selected at random, then in succession the sections of the selected sequence are selected, and for each selected section one group of the audio materials is selected at random for playing

BRIEF DESCRIPTION OF DRAWINGS

Hereinafter, the invention will be described by means of preferred embodiments as shown in the drawings, where FIG. 4 is a music piece matrix of a preferred embodiment, FIG. 5 is a first section matrix of the embodiment containing the music piece matrix of FIG. 4, FIG. 6 is a second section matrix of the embodiment containing the music place matrix of FIG. 4, FIG. 7 is a third section matrix of the embodiment containing the music piece matrix of FIG. 4.

MODES FOR CARRYING OUT THE INVENTION

Figure 1:
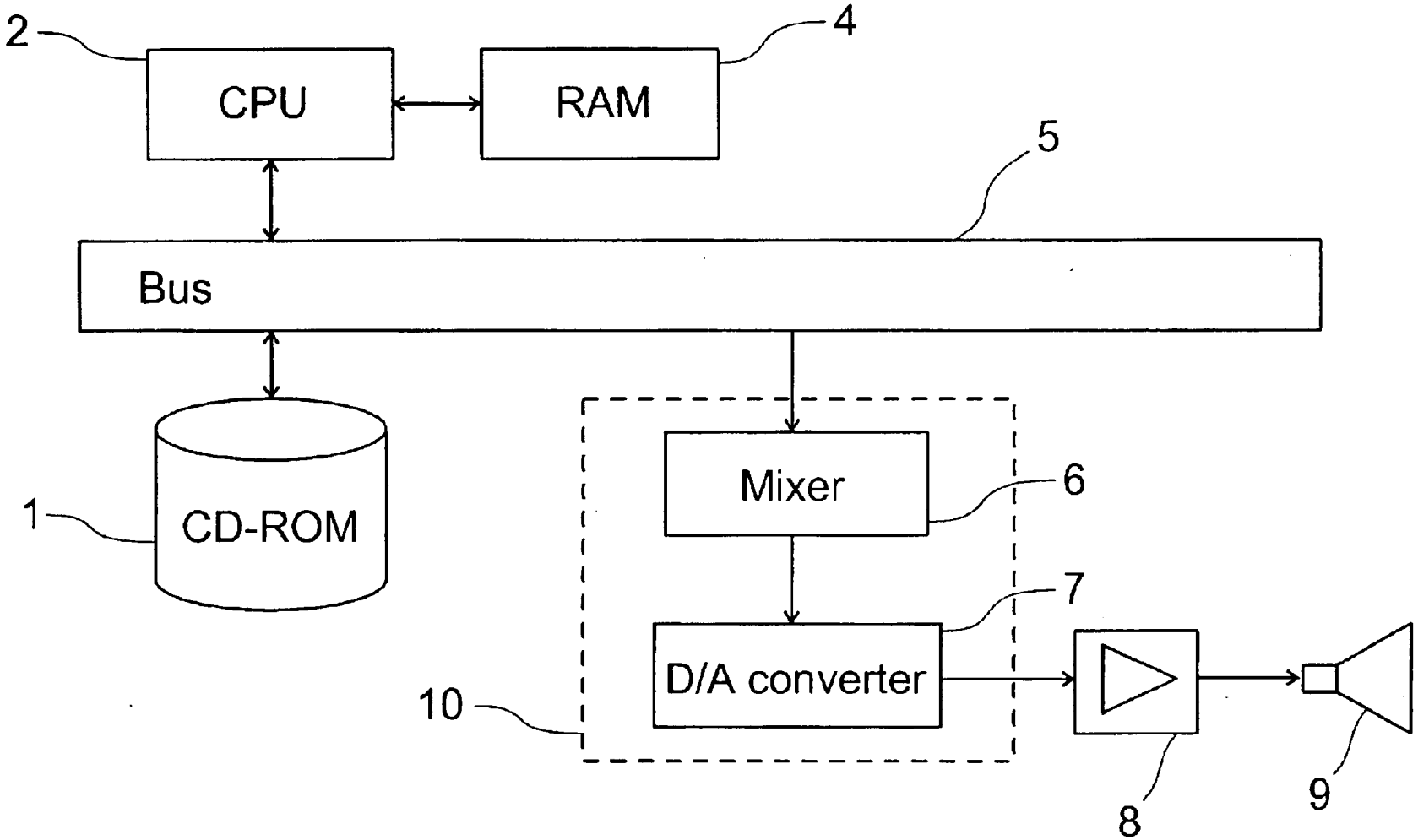
FIG. 1 is a schematic block diagram of a preferred embodiment of the apparatus according to the invention.

The preferred embodiment shown in FIG. 1 is a simplified drawing of a multimedia computer known per se, from which for the sake of simplicity components insignificant from the aspect of the invention are omitted. The computer comprises a memory 1, which is a CD-ROM in the depicted embodiment. The CD-ROM is placed into a CD-ROM drive (not shown) of the multimedia computer, and is linked to a central processing unit 2 via bus 5, which central processing unit 2 is connected to a RAM 4. The RAM 4 includes a computer program 3 running on the computer. Furthermore, a sound board 10 comprising a mixer 6 and a D/A converter 7 is connected to the bus 5. An output of the D/A converter 7 is connected via an amplifier 8 to a stereo speaker unit 9.

The multimedia computer enables a relatively simple implementation of the apparatus according to the invention. The audio materials, which are digitised sound samples of solo musical instruments in the depicted embodiment, are stored in the CD-ROM. In the preferred embodiment, the databases describing the improvised music pieces are also stored in the CD-ROM. According to the invention, however, the audio materials and the databases are not necessarily stored in the same memory 1, but they can be stored separately as well. In this case under memory 1 a set of separate memory means are to be understood. According to the invention, under a music piece not only a music piece composed of sounds of musical instruments is understood, but also a music piece composed of any type of sounds, for example noises, human voices etc. In this case sound samples of sound types are stored in the memory.

Figure 2:
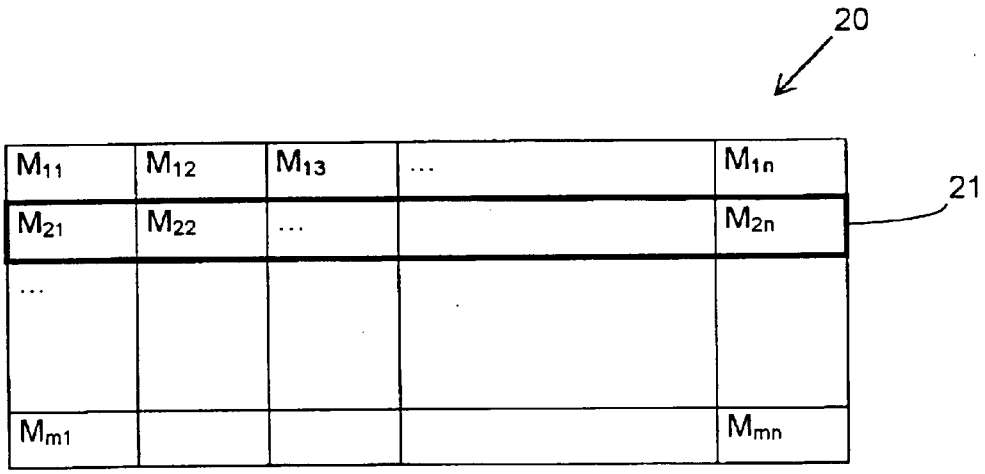
FIG. 2 depicts the structure of a general music piece database formed as a matrix.
Figure 3:
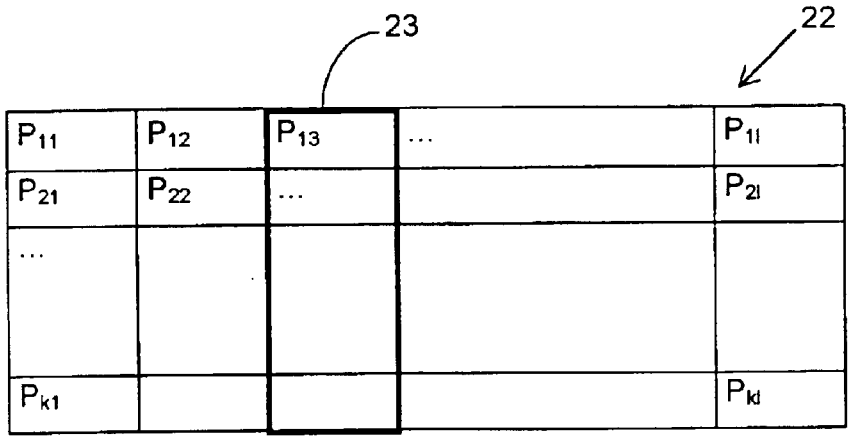
FIG. 3 depicts the structure of a general section database formed as a matrix.

The databases describing the music pieces are stored in the CD-ROM in the form of a music piece database 20 formed as a matrix according to FIG. 2. We have found that improvised music pieces can be divided into sections and can be played as a sequence of the sections. The lines of the music piece matrix correspond to the variations of the music piece, and the columns represent the sections. It can be seen that the music piece database 20 shown in FIG. 2 comprises m variations and each variation comprises n sections. The elements $M_{ij}$ the matrix of the music piece database 20 comprise references to section databases 22, which are formed as a matrix shown in FIG. 3. Thereby, the lines of the music piece database 20 contain sequences 21 comprising references to the section databases 22. Of course, the sequences do not have to fill the lines of the music piece database 20, but at the ends of the lines there can be one or more empty elements.

The elements $P_{ij}$ of the section database 22 are records comprising references to the audio materials. In the depicted embodiment, the lines of the matrix of the section database 22 correspond to solo musical instruments, and the elements in one line are records comprising references to digitised sound samples of the solo instruments. It can be seen that the section database 22 comprises references to I sound samples of k musical instruments. The sound samples of the solo instruments are arranged into at least one group 23 in a way that each group comprises sound samples that—according to the improvisation concept—can be played simultaneously in a mixed manner. The sound samples are preferably arranged in the matrix of the section database 22 in a way that the records in the same column of the matrix represent one group 23.

It will be shown below that the improvisation rules are determined by the music piece databases 20 and the section databases 22. This is because the music piece is played in a way that by means of the computer program—on the basis of a random number as a random factor—one sequence 21 is selected from the music piece database 20, and then corresponding to the references in the selected sequence, in each referenced section database 22 one group of the records is selected at random, and the audio materials of the selected group are mixed for simultaneous playing. This means that the improvised music piece only depends on the random factor in addition to the structure and contents of the music piece database 20 and the section databases 22. The audio materials are played seemingly at random, but in reality they are played according to the rules determined by the databases.

Furthermore, still or moving pictures can be preferably assigned to the groups 23 of the audio materials in the section databases, which still or moving pictures are stored in memory 1, and when simultaneously playing the audio materials of the group 23 selected, the still or moving pictures associated with the selected group 23 can be displayed. In this way complex audio-visual improvisation can be provided. By means of the computer program 3, the display can be implemented for example on a screen (not shown) of the computer.

The still or moving pictures can be preferably associated with the groups 23 in the section databases 22 formed as matrices in the following way. The section databases 22 can be completed with a further line, which includes references to the files storing the still or moving pictures, for example the names of the files. Therefore, when selecting the groups 23 in the form of columns of the matrices, still or moving pictures are also selected for being displayed. Of course, one still or moving picture can be simultaneously associated with several groups within one section or with groups of other sections or music pieces.

FIGS. 4–7 depict databases describing a music piece as an example. The music piece shown consists of three sections, three section databases, and there are fifteen audio materials for composing the sections.

FIG. 4 shows a music piece matrix 24, which contains three sections in each variation. The sections are of identical lengths. The elements of the music piece matrix 24 are references A, B and C to section matrices 25, 27 and 29, respectively, shown in FIGS. 5–7. If in this embodiment it is allowed for sections to be repeated within one music piece, the music piece can be played in $3^3$ variations. However, the improvisation concept does not necessarily contain all the variations. Assuming that in the case of the present music piece the improvisation concept allows ten types of variations, the music piece matrix shall contain ten lines in a way shown in the figure. Of course, the number of sections does not necessarily have to be equal to the number of section databases, but it could be more or less.

The section matrix 25 consists of records 26 containing references to the audio materials 31. The references in the depicted preferred embodiment are names of files of the audio materials 31, which files contain sound samples of musical instruments in WAVE format. In the depicted embodiment the sound samples have a length corresponding to an integer fraction of the section, but they could also be of a length equal to the length of the section. In FIG. 5 the records 26 of the fourth column as group 23 are selected for simultaneous playing.

The records 26—in addition to the file names of the sound samples—also comprise parameters 32 referring to mixing mode and playing mode of the sound samples, which parameters are the number of repetitions within the section, the stereo position and the relative volume. The length of all music sections in the depicted embodiment is 48 s and those of the sound samples are 3, 6 and 12 s. Accordingly, the number of repetitions are 16, 8 and 4, respectively. The stereo position by way of example could change between −40 dB and +40 dB, and the relative volume may vary between 0 and 100%. In the depicted embodiment the stereo position is 0 and the relative volume is 100% in the case of each audio material 31, i.e. each audio material 31 sounds from the centre and with the same volume.

According to the invention, the section matrices may also contain empty records, if it is not intended to sound the given instrument with the audio materials in the given column. Such empty records can be seen in the last line of section matrix 25, in the first three columns.

The section matrices 27 and 29 with records 28 and 30, respectively, are designed similarly to section matrix 25. The section matrix 25 includes three types of instruments and five groups, the section matrix 27 includes three types of instruments and three groups, and the section matrix 29 includes four types of instruments and one group. It can be seen that in the matrices describing the music piece, a given audio material 31 is referenced from several section matrices and within one section matrix from several groups. This is advantageous because the space for storing the music piece is further reduced. In addition, the audio materials 31 may be associated with several music pieces stored in the CD-ROM, for example a drum solo could appear in several music pieces. This further reduces the storage space.

The audio materials 31 can be generated by digitising the sounds of solo musical instruments. Digitising can be carried out by the sound board 10 having an analogue input and an A/D converter, but the audio materials 31 may also be generated by sectioning of digitised music compositions. Of course, the audio materials 31 must not necessarily be sound samples of musical instruments, they may be for example sampled noises, sounds generated by computer or sampled human singing voices. Selecting the sound samples associated with the music piece is based on the improvisation concept and they can be matched to the required style of the music piece.

Figure 8:
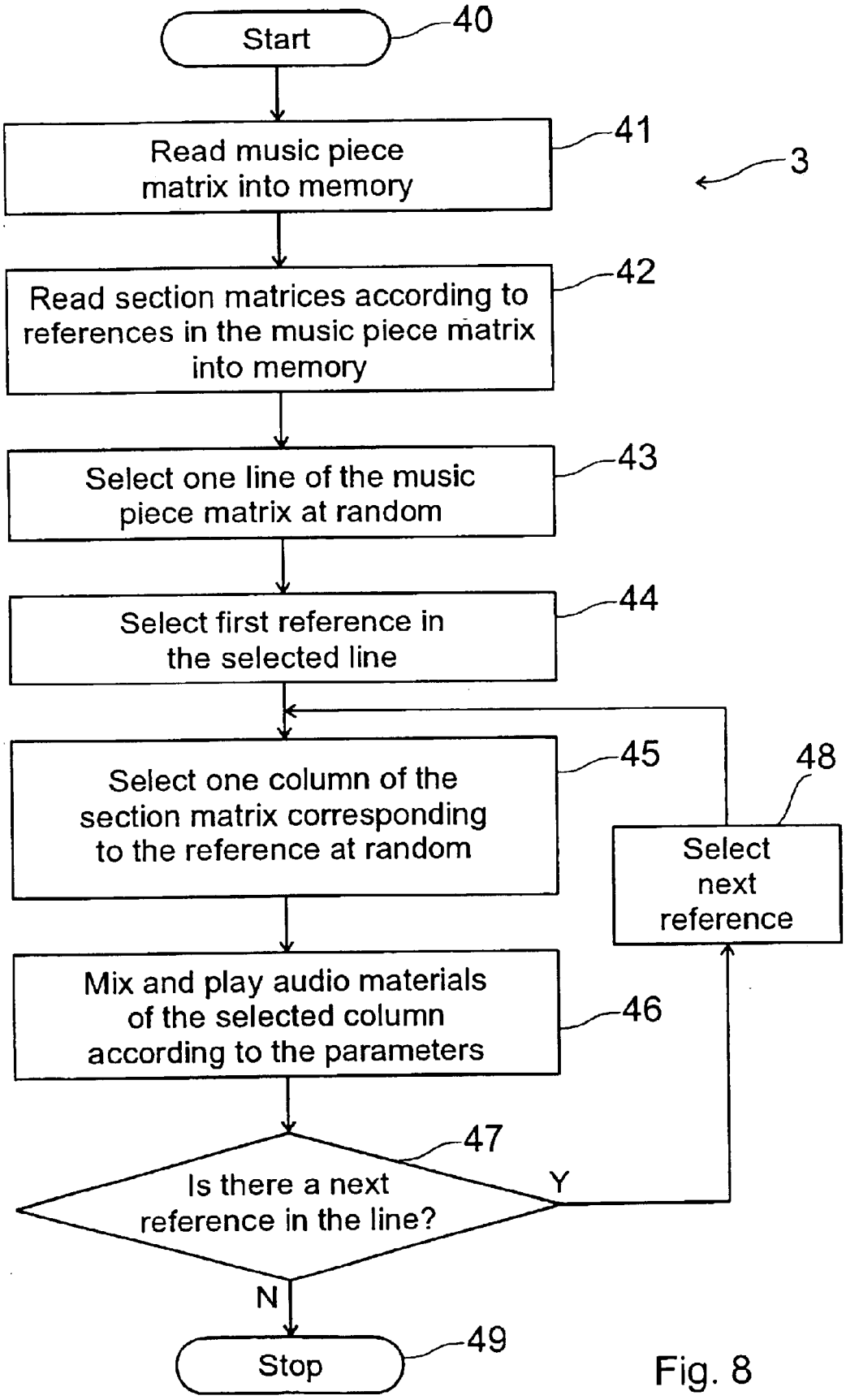
FIG. 8 is a schematic flowchart of a computer program used in the apparatus.

The playing of the improvised music can be carried out according to the flowchart of FIG. 8 with the computer program 3. A user or a computerised algorithm may select from the music piece matrices stored in the CD-ROM. After selecting the music piece matrix, the computer program 3 starts with a program start step 40. After starting the computer program 3, within the framework of steps 41 and 42, the music piece matrix and the section matrices corresponding to the references in the music piece matrix are read from the CD-ROM into the RAM 4.

Next, in step 43, by means of a random number generator implemented in the computer program 3, a first random number is generated and on basis this random number one line of the music piece matrix is selected. Next, in step 44, the first reference in the selected line is selected. Subsequently, by means of the random number generator implemented in the computer program 3, a second random number is generated and on basis of this random number one column is selected from the section matrix corresponding to the reference, as it is depicted by step 45.

The audio materials in the records of the selected column are mixed according to the parameters in the records, i.e. the number of repetitions, the stereo position and the relative volume, and they are played simultaneously. The mixing of audio materials may also be carried out in the computer program 3, but it is preferably carried out by a mixer 6 in the sound board 10. Next, by means of the D/A converter 7 in the sound board 10, the mixed material is converted into an analogue signal, and then by supplying the analogue signal through the amplifier 8 to the stereo speaker unit 9, the mixed material is converted into sound.

If a reference to a still or moving picture is stored in the selected column of the section matrix, the still or moving picture associated with the selected column is forwarded by means of the computer program to a display unit and they are displayed simultaneously with playing the audio materials of the selected column.

To enable continuous playing, while playing the relevant section it is examined whether there is a next reference in the selected line of the music piece matrix. If there is a next reference in the line, a transfer is made from a branching testing step 47 to step 48, in which the next reference in the line is selected. Then, a transfer is made to step 45 again, in which a column is selected from the section matrix corresponding to the reference, and the audio materials of this column are played in the framework of step 46. This process is continued until a next reference exists in the selected line of the music piece matrix.

If a negative answer is obtained from the test in the branching step 47, i.e. there is no next reference in the selected line, the computer program ends with a program stop step 49.

If the apparatus according to the invention is a general purpose multimedia computer, it is advisable to supplement the computer program 3 described above with a graphic user platform. In that case, the computer program 3 can be preferably implemented in Microsoft VisualStudio and Microsoft DirectX SDK environment. Microsoft DirectX SDK provides a standard programming platform for most currently marketed sound boards, which substantially simplifies the programming task.

It is shown by the description above that for playing of relatively long improvised music pieces, a relatively small number of audio materials have to be stored. For example, in the embodiment depicted in FIGS. 4–7, a single variation of the music piece consisting of three sections results in a longer improvised music than the total joint length of the fifteen audio materials necessary for generating it. When all the variations of the music piece are taken into consideration, the playing time of the improvised music that can be generated may even be several hundred times the total length of the stored audio materials. Thereby it becomes possible to store the audio materials without compressing, by which an eventual quality deterioration entailed by some compressing methods can be avoided.

The method, apparatus and computer program product according to the invention may be implemented in ways different from those described above. For example, it is not necessary to stop the program after playing one variation of the selected music piece, but the playing of other variations of the selected music piece or variations of a different music piece can be continued at random. In that case, for example, the improvised music can be stopped by the user with an appropriate command. The music piece matrices can store the reference sequences in the columns, and the section databases can be formed as matrices having columns corresponding to the sound types and rows forming the groups. In the records of the section databases, parameters different from those above can be stored. It is not necessary to store the audio materials, the matrices describing the music pieces and in the given case the still or moving pictures in the same memory, for example CD-ROM, but they may be separately stored in different data carriers.

In addition, the method, apparatus and computer program product according to the invention may not only be applied in a multimedia computer but also in video, Internet on-line and off-line audio and audio-visual services, or even for generating a ringing sound of a mobile telephone set.

It will be evident to those skilled in the art that the above disclosure is exemplary only and that various other alternatives, adaptations and modifications may be made within the scope of the present invention as defined by the following claims.

What is claimed is:

1. An apparatus for playing audio materials in the form of a music piece consisting of sections, the apparatus comprising:

a memory storing the audio materials associated with the sections;

a central processing unit connected to the memory;

a computer program for controlling the apparatus and for playing the audio materials in an improvised manner; and a mixer and a decoder for mixing and decoding the audio materials into sounds, wherein a plurality of predetermined sequences of successive sections are stored in the memory with each predetermined sequence representing variations of the music piece, the audio materials associated with the sections are sorted into at least one predetermined group for each section, such that the at least one group is formed according to simultaneously playable audio materials, and wherein the computer program randomly selects one sequence of the plurality of predetermined sequences, then the sections corresponding to the randomly selected sequence are successively selected, and for each selected section, one group of the audio materials is randomly selected for playing.

2. The apparatus according to claim 1, wherein the memory comprises section databases with records storing references to the audio materials and the at least one group is formed by the records, wherein the memory further comprises a music piece database for storing sequences consisting of references to the section databases.

3. The apparatus according to claim 2, wherein the section databases are formed as section matrices, wherein the groups are formed by records in the same column of a section matrix, and the music piece database is formed as a music piece matrix, wherein the sequences corresponding to music piece variations are stored in the lines of the music piece matrix.

4. The apparatus according to claim 3, wherein lines of the section matrix correspond to musical instruments and elements of the section matrix in one line are records contacting the references to sound samples of the corresponding musical instrument.

5. The apparatus according to claim 2, wherein the audio materials have a length identical with the length of the corresponding section or they are of a length corresponding to an integer fraction of the section, and the records comprise parameters relating to mixing mode and/or playing mode of the audio materials.

6. The apparatus according to claim 1, wherein the memory comprises audio materials associated with several groups, which groups can be within one section, in several sections of one music piece or in the sections of several music pieces.

7. The apparatus according to claim 1, wherein in the memory still or moving pictures are stored associated with the groups, and the apparatus comprises a unit for displaying the still or moving pictures associated with the selected group when the audio materials of the selected group are played.

8. The apparatus according to claim 1, wherein the apparatus is a computer system, in which the memory is a CD-ROM, and the mixer is arranged in the decoder, wherein the decoder is a sound board comprising a D/A converter.

9. A method for playing audio materials in the form of a music piece consisting of sections by means of a hardware system, the hardware system comprising:

a memory storing the audio materials associated with the sections;

a central processing unit connected to the memory; and a computer program for controlling the apparatus and for playing the audio materials in an improvised manner; and a mixer and a decoder for mixing and decoding the audio materials into sounds, wherein a plurality of predetermined sequences of successive sections are stored in the memory with each predetermined sequence representing variations of the music piece, the audio materials associated with the sections are sorted into at least one predetermined group for each section, such that the at least one group is formed according to simultaneously playable audio materials, and wherein the computer program randomly selects one sequence of the plurality of predetermined sequences, then the sections corresponding to the randomly selected sequence are successively selected, and for each selected section, one group of the audio materials is randomly selected for playing and is forwarded to the mixer and decoder for mixing and converting the audio materials into sound.

10. The method according to claim 9, wherein the memory comprises section databases with records storing references to the audio materials, wherein the at least one group is formed by the records, and the memory comprises a music piece database for storing the sequences consisting of references to the section databases.

11. The method according to claim 10, wherein the section databases are formed as section matrices, wherein the groups are formed by records in the same column of the section matrix, and the music piece database is formed as a music piece matrix, wherein the sequences corresponding to music piece variations are stored in the lines of the music piece matrix.

12. The method according to claim 10, wherein the audio materials are sound samples of solo musical instruments obtained by sampling, and the lines of the section matrix correspond to the musical instruments and elements of the section matrix in one line are the records containing the references to the sound samples of the corresponding musical instrument.

13. The method according to claim 12, wherein the records comprise parameters relating to mixing mode and/or playing mode of the audio materials and the mixing and/or playing of the audio materials of the selected group are carried out according to the parameters.

14. The method according to claim 13, wherein the parameters are the number of repetitions of the audio material within the section, and stereo position and relative volume of the audio material.

15. The method according to claim 9, wherein the memory comprises audio materials associated with several groups, which groups can be within one section, in several sections of one music piece or in the sections of several music pieces.

16. The method according to claim 9, wherein in the memory still or moving pictures are stored associated with the groups, and the still or moving pictures associated with the selected group are displayed when the audio materials of the selected group are played.

17. A method for playing audio materials in the form of a music piece consisting of sections, the method comprising:

(a) storing the the audio materials associated with the sections in a memory, wherein the memory comprises a predetermined music piece database containing a plurality of predetermined sequences in which each predetermined sequence represents variations of the music piece, the music piece database containing references to predetermined section databases, the predetermined section databases having elements containing references to the audio materials in which the audio materials are sorted into at least one predetermined group for each section such that the at least one group is formed according to simultaneously playable audio materials;

(b) selecting the audio materials to play in an improvised manner by randomly selecting one sequence from the music piece database, successively selecting each section corresponding to the randomly selected sequence, and randomly selecting one group of the elements in each section database; and (c) playing the audio materials referenced by the elements of the randomly selected group by mixing the audio materials for simultaneous playing.

18. The method according to claim 17, wherein the section databases are formed as section matrices, wherein lines of the section matrix correspond to sound types, and the elements of the section matrix in one line are containing references to sound samples of the sound types, and wherein the groups are formed by records in the same column of the section matrix.

19. The method according to claim 18, wherein the records comprise parameters relating to mixing mode and/or playing mode of the audio materials, and wherein mixing and/or playing of the sound samples of the selected group are carried out according to the parameters.

20. The method according to claim 19, wherein the parameters are the number of repetitions of the sound sample within the section, and stereo position and relative volume of the sound sample.

21. The method according to claim 18, wherein the music piece database is a music piece matrix, wherein the sequences corresponding to music piece variations are stored in the lines of the music piece matrix.

22. The method according to claim 18, wherein the sound samples are obtained by sampling of sounds of solo instruments.

23. The method according to claim 17, wherein in the memory still or moving pictures are stored associated with the groups, and the still or moving pictures associated with the selected group are displayed when the audio materials of the selected group are played.

24. A computer program product for playing audio materials in the form of a music piece consisting of sections in an improvised manner, the computer program product comprising:

means for accessing a memory in which the audio materials associated with the sections are stored, the memory being configured to store a plurality of predetermined sequences representing variations of the music piece with each predetermined sequence comprising successive sections and to sort the audio materials associated with each section into at least one predetermined group formed according to simultaneously playable audio materials;

means for randomly selecting one sequence from the plurality of predetermined sequences;

means for selecting the sections corresponding to the randomly selected sequence in succession;

means for randomly selecting one predetermined group of the audio materials for each selected section for playing; and means for supplying the selected predetermined group of the audio materials to a decoder for converting the audio materials into sound.

25. The computer program product according to claim 24, wherein the memory comprises section database having records for storing references to the audio materials, wherein the at least one group is formed by the records, and the memory comprises a music piece database for storing sequences consisting of references to the section databases.

26. The computer program product according to claim 25, wherein the section databases are formed as section matrices, wherein the groups are formed by records in the same column of the section matrix, and the music piece database is formed as a music piece matrix, wherein the sequences corresponding to music piece variations are stored in the lines of the music piece matrix.

27. The computer program product according to claim 26, wherein the audio materials are sound samples are sound samples of solo musical instruments obtained by sampling, wherein lines of the section matrix correspond to the musical instruments and elements of the section matrix in one line are records contacting references to the sound samples of the corresponding musical instrument.

28. The computer program product according to claim 25, wherein the records comprise parameters relating to mixing mode and/or playing mode of the audio materials, and mixing and/or playing of the audio materials of the selected group are carried out according to the parameters.

29. The computer program product according to claim 28, wherein the parameters are the number of repetitions of the audio material within the section, and stereo position and relative volume of the audio material.

30. The computer program product according to claim 24, wherein the memory comprises audio materials associated with several groups, which groups can be within one section, in several sections of one music piece or in the sections of several music pieces.

31. The computer program product according to claim 24, wherein in the memory still or moving pictures are stored associated with the groups, and the computer program product comprises means for transferring the still or moving pictures associated with the selected group to a display unit when the audio materials of the selected group are played.

* * * * *

UNITED STATES PATENT AND TRADEMARK OFFICE

CERTIFICATE OF CORRECTION

PATENT NO. : 6,867,358 B1
DATED : March 15, 2005
INVENTOR(S) : Mester et al.

It is certified that error appears in the above-identified patent and that said Letters Patent is hereby corrected as shown below:

Title page,
Item [76], Inventor, replace "Sandor Mester, Jr., Paulay Ede. u. 57, Budapest (HU), H-1061" with -- Sandor Mester, Jr., Visegradi utca 43-45, II/8, H-1132 Budapest, Hungary --.

Signed and Sealed this

Twelfth Day of July, 2005

JON W. DUDAS
*Director of the United States Patent and Trademark Office*